US006237236B1

(12) United States Patent
Schnell

(10) Patent No.: US 6,237,236 B1
(45) **Date of Patent: *May 29, 2001**

(54) BORE SIGHTING APPARATUS, SYSTEM, AND METHOD

(75) Inventor: Tim Schnell, 3708 Cobblestone Ct., Bedford, TX (US) 76021

(73) Assignee: Tim Schnell, Bedford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/504,032

(22) Filed: Feb. 14, 2000

Related U.S. Application Data

(63) Continuation of application No. 09/286,390, filed on Apr. 5, 1999, now Pat. No. 6,061,918.

(51) Int. Cl.[7] ..... F41G 3/00
(52) U.S. Cl. ..... 33/334
(58) Field of Search ..... 33/234; 42/90; 356/153; 362/111

(56) References Cited

U.S. PATENT DOCUMENTS

| | | | |
|---|---|---|---|
| 2,773,309 | 12/1956 | Elliott | 33/46 |
| 3,734,627 | 5/1973 | Edwards | 356/153 |
| 3,782,832 | 1/1974 | Hacskaylo | 356/153 |
| 4,136,956 | 1/1979 | Eichweber | 356/153 |
| 4,172,274 | 10/1979 | Zemke | 362/111 |
| 4,191,471 | 3/1980 | Courten et al. | 356/154 |
| 4,367,516 | 1/1983 | Jacob et al. | 362/111 |
| 4,481,561 | 11/1984 | Lanning | 362/111 |
| 4,530,162 | 7/1985 | Forrest et al. | 33/228 |
| 4,825,258 | 4/1989 | Whitson | 356/153 |
| 4,830,617 | 5/1989 | Hancox et al. | 434/21 |
| 4,875,303 | 10/1989 | DeWeert et al. | 42/90 |
| 4,879,814 | 11/1989 | Wallace et al. | 33/234 |
| 4,983,123 | 1/1991 | Scott et al. | 434/21 |
| 5,001,836 | 3/1991 | Cameron et al. | 33/234 |
| 5,060,391 | 10/1991 | Cameron et al. | 33/234 |
| 5,119,576 | 6/1992 | Erning | 42/103 |
| 5,127,179 | 7/1992 | Marsh | 42/90 |
| 5,241,458 | 8/1993 | Abbas | 362/110 |
| 5,365,669 | 11/1994 | Rustick et al. | 33/234 |
| 5,410,815 | 5/1995 | Parikh et al. | 33/234 |
| 5,432,598 | 7/1995 | Szatkowski | 356/153 |
| 5,446,535 | 8/1995 | Williams | 356/153 |
| 5,454,168 | 10/1995 | Langner | 33/234 |
| 5,476,385 | 12/1995 | Parikh et al. | 434/22 |
| 5,488,795 | 2/1996 | Sweat | 42/103 |
| 5,685,106 | 11/1997 | Shoham | 42/103 |
| 5,787,631 | 8/1998 | Kendall | 42/103 |
| 6,061,918 * | 5/2000 | Schnell | 33/234 |

* cited by examiner

*Primary Examiner*—Michael J. Carone
*Assistant Examiner*—Denise J. Buckley
(74) *Attorney, Agent, or Firm*—Schwegman, Lundberg Woessner & Kluth, P.A.

(57) ABSTRACT

An apparatus, system, and method for bore sighting a gun. A hollow shell casing is attached to a single light source and then placed in the breech of a gun. Light is projected from the gun onto a pre-calibrated target. The user is then able to adjust the gun sights accordingly. There are a plurality of shell casings interchangeably mountable to the single light source, enabling the user to sight in a variety of guns using only one system. The shell casings may be the same shape as standard shells for the type of gun being sighted in.

11 Claims, 5 Drawing Sheets

BORE SIGHTING APPARATUS, SYSTEM, AND METHOD

"This application is a continuation of U.S. Ser. No. 09/286,390, filed Apr. 5, 1999 now U.S. Pat. No. 6,061,918."

TECHNICAL FIELD

The present invention relates generally to a gun bore sighting apparatus, and more particularly to a system for using a housing to hold the light source that is used for bore sighting.

BACKGROUND

It is important to sight in, or adjust, the mechanical or telescopic sight of a gun to be assured that the bullet goes to the exact point that the shooter was aiming at through the sights. Sighting in a gun is usually accomplished by mounting the gun to a fixed stand, aiming at a target, firing a shot, and then adjusting the sight of the gun depending on where the bullet hit the target. The process is repeated until the shooter is satisfied with the accuracy of the sight.

Bore sighting using a light source was developed so that a gun could be sighted in without expenditure of ammunition and without the need to go to an area that was safe enough to shoot in. In this method, a light is projected down the barrel of the gun. When the light is emitted, it hits a target placed a predetermined distance away. The center of the light beam is ascertained and the user then adjusts the gun sights accordingly.

One problem encountered using bore sighting systems is that the housing holding the light source does not always fit accurately inside the gun chamber to provide an accurate beam of light. Since every different caliber gun has a different size barrel, the user may only get an approximate fitting of housing to chamber, or the user may have to buy a different apparatus for each of their guns.

U.S. Pat. No. 5,454,168 to Langner is one bore sighting apparatus which uses a light source. In Langner, the light source is enclosed in a single, cylindrical stepped housing which is placed in the breech of the gun. The housing is stepped so that the single housing is able to fit a limited number of pre-determined different caliber guns. Another bore sighting apparatus is U.S. Pat. No. 4,481,561 to Lanning. In Lanning, the light and light power source are both enclosed inside a housing which is shaped like a standard cartridge.

The disadvantages facing a user of a bore sighting apparatus are that either they have to buy a separate unit for each caliber gun they desire to sight in, or they are only able to get an approximate fit to a limited number of different caliber guns. It is desirable to provide a single, inexpensive system for bore sighting in which the housing holding the light source can be accurately positioned in all the different caliber guns a user has.

SUMMARY OF THE INVENTION

The present invention provides an accurate and inexpensive system for a person who desires to sight in a plurality of different caliber guns. The system includes a single light source having a mounting section, and a plurality of shell casings for different caliber guns that interchangeably mount on the single light source. The shell casings house the light source when it is inserted into the breech of the gun. Since the mounting section of each shell casing is the same standard size, the system allows the user to sight in a wide variety of guns using the single light source and a series of shell casings.

In further embodiments, the invention also provides the user with interchangeable muzzle tubes, an external power source for the light source, and a target to be used for sighting in the gun. The interchangeable muzzle tubes also allow the user to use the system to sight in a wide variety of guns.

In further embodiments, the invention provides a shell casing that is the same shape as a standard shell for the type of gun being sighted in. This has the advantage of allowing the gun to be bore sighted very accurately because the light source will be centered down the center of the barrel of the gun. Furthermore, because the shell casing itself is in the exact shape of a shell for that caliber of gun, the shell casing will fit snugly and not cause any internal damage to the gun.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined or that other embodiments may be utilized and that structural changes may be made without departing from the spirit and scope of the present invention. The following detailed description is, therefore, not to be taken in a limiting sense, and the scope of the present invention is defined by the appended claims and their equivalents.

Figure 1:
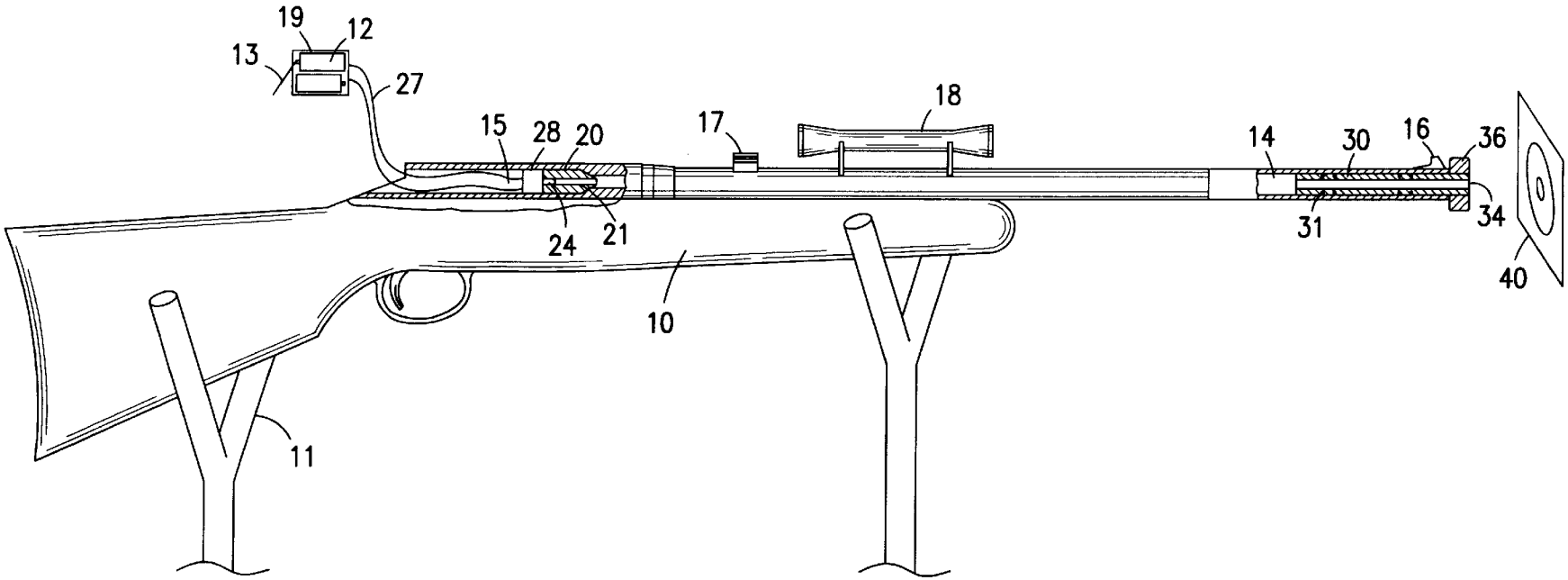
FIG. 1 is a view of the bore sighting apparatus in a firearm.

FIG. 1 shows one embodiment of a bore sighting apparatus in a firearm to be sighted in. In FIG. 1, a gun 10, having a breech 15, a barrel 14, a rear sight 17, a front sight 16, and a telescopic sight 18, is mounted to a fixed surface using clamps 11. A shell casing 20, attached to a light source unit 28, is inserted into breech 15 of gun 10. A muzzle tube 30 is inserted into the end of barrel 14. Light source unit 28 is connected to a power source 12, which is located outside of the breech of the gun, by an electrical connector 27. Power source 12 is activated by a switch 13. One example of power source 12 is two "AA" batteries, enclosed in a holder 19. Holder 19 is dimensioned to fit within a shirt pocket. This allows the user to have easy access to it, and allows the power source to be unobtrusive.

Light source unit 28 contains a light source 24, which emits a light which travels through a passage 21 of shell casing 20, then through barrel 14 of gun 10. The light is collimated when it goes through muzzle tube 30, is then emitted from the end of the muzzle tube 30, and is reflected off of target 40.

Figure 4:
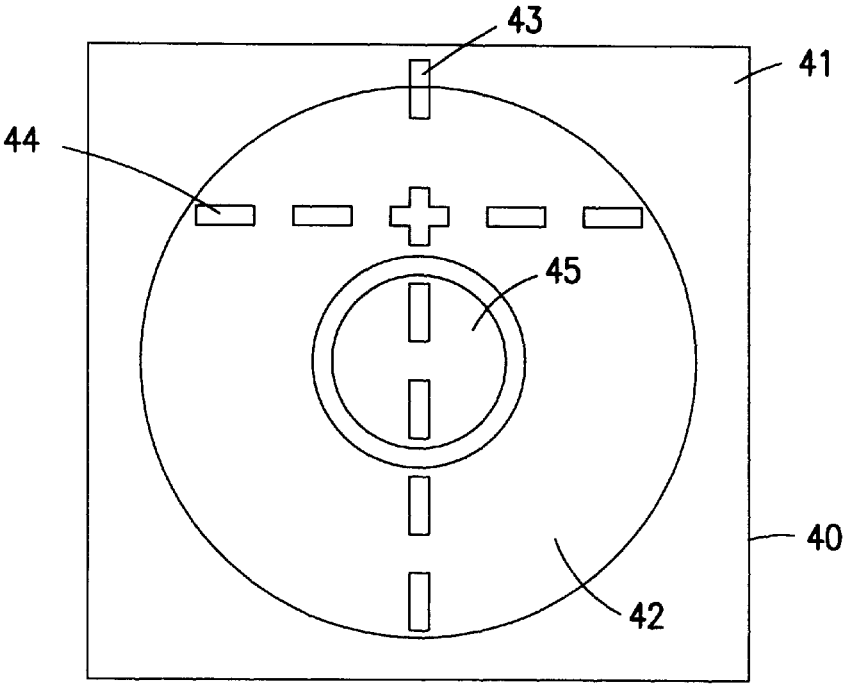
FIG. 4 is a view of the target.

FIG. 4 shows an illustrative target 40. Target 40 has a dark nonreflective section 41, a reflective section 42, and a center portion 45. It also contains a vertical line 43 and a horizontal line 44. Horizontal line 44 is offset from the center of target 40. The user adjusts target 40 and gun 10 until the light emitted from gun 10 is centered on center portion 45. The user then adjusts mechanical sight 17 so that when viewed in conjunction with front sight 16 the sights align with vertical line 43 and horizontal line 44. Horizontal line 44 is offset a pre-determined distance to allow for the trajectory of the bullet fired from gun 10. A different horizontal line 44 can be used depending on the distance and trajectory the gun will be fired. Another embodiment is that telescopic sight 18 is used as the sighting mechanism instead of mechanical sights 16, 17.

Although having the gun 10 mounted to a fixed surface is one embodiment, the gun 10 can also be sighted in by the user holding the gun 10 and then following the same procedure as set out above.

Figure 2B:
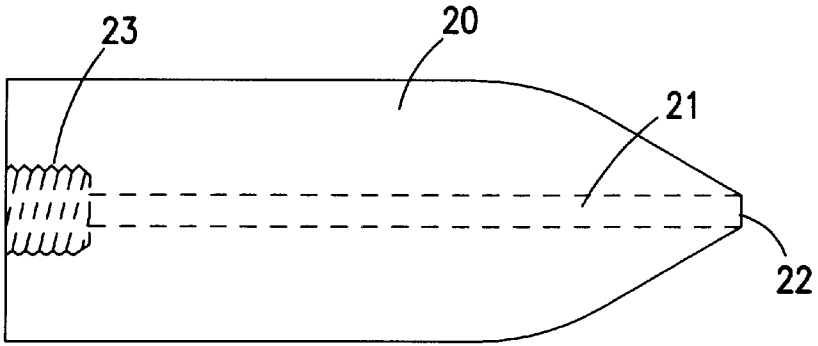
FIG. 2B is a detailed view of a shell casing.
Figure 2A:
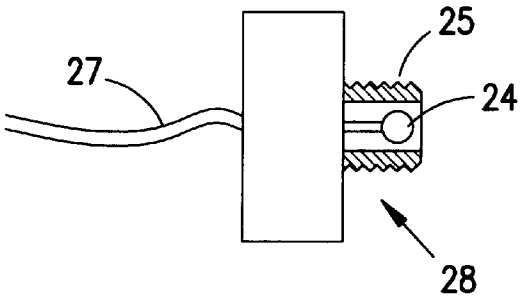
FIG. 2A is a detailed view of the light source.

FIG. 2A shows an illustrative light source unit 28. Light source unit 28 is connected to power source 12 by electrical connector 27. Electrical connector 27 is a standard electrical cord. The light source 24 is a focused laser, however, those skilled in the art will recognize that an unfocused laser or a standard lightbulb could also be used. Light source unit 28 also has a mounting section 25.

FIG. 2B shows one of the plurality of interchangeable shell casings 20. Shell casing 20 has a mounting section 23 to allow shell casing 20 to be attached to light source mounting section 25. In one embodiment, the light source mounting section 25, and the shell casing mounting section 23 are threaded, however the sections could be connected in any equivalent manner such as friction fitting, press fitting or counterbolt fitting. The shell casing 20 also contains a passage 21 axially located which goes through the shell casing. Passage 21 allows the light from light source 24 to pass through shell casing 20. Shell casing passage 21 terminates at a center tip 22 of shell casing 20.

Shell casing 20 is substantially similar in shape and length to a standard cartridge for a gun of the caliber being sighted in. This is so that the shell casing will fit with close tolerance in the chamber, and also so that it will not cause any damage to the inside of the gun. By being the same length as a standard shell, the shell casing also will have a high degree of stability inside the chamber of the gun 10. The advantage is that the shell casing will be supported for its full length, and will not have any wobble.

One material for shell casing 20 is brass. This adds the advantage of being malleable and easy to machine, yet hard and relatively inexpensive. Brass is a common choice of shell manufacturers for the same reasons as noted above. However, those skilled in the art will recognize that other materials can be chosen based on need and economics.

Figure 3A:
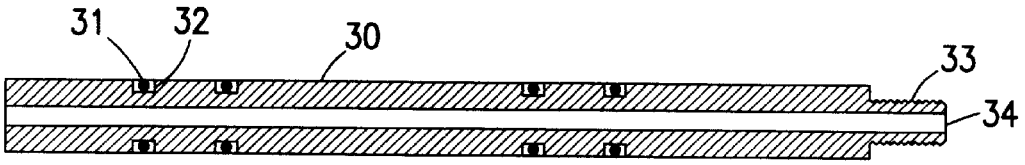
FIG. 3A is a detailed view of the muzzle tube.
Figure 3B:
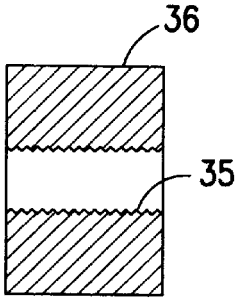
FIG. 3B is a detailed view of the muzzle tube handle.

FIGS. 3A and 3B show a view of an interchangeable muzzle tube system. One of a plurality of interchangeable muzzle tubes 30 has a mounting section 33 and central passage 34. A single muzzle tube handle 36 has a mounting section 35 that fits all muzzle tubes. Muzzle tube mounting section 33 is inserted into handle mounting section 35 and the user inserts muzzle tube 30 into the muzzle of gun 10. The single muzzle tube handle 36 allows muzzle tube 30 to be easily removed. The mounting sections 33, 35 are shown as threaded sections, however the sections could be connected in any equivalent manner such as friction fitting, press fitting or counterbolt fitting. Another embodiment of a muzzle tube system includes a plurality of compressible O-rings 31. Each o-ring having a different external diameter, to allow muzzle tube 30 to fit tightly into the muzzle of different caliber gun barrels.

Figure 5:
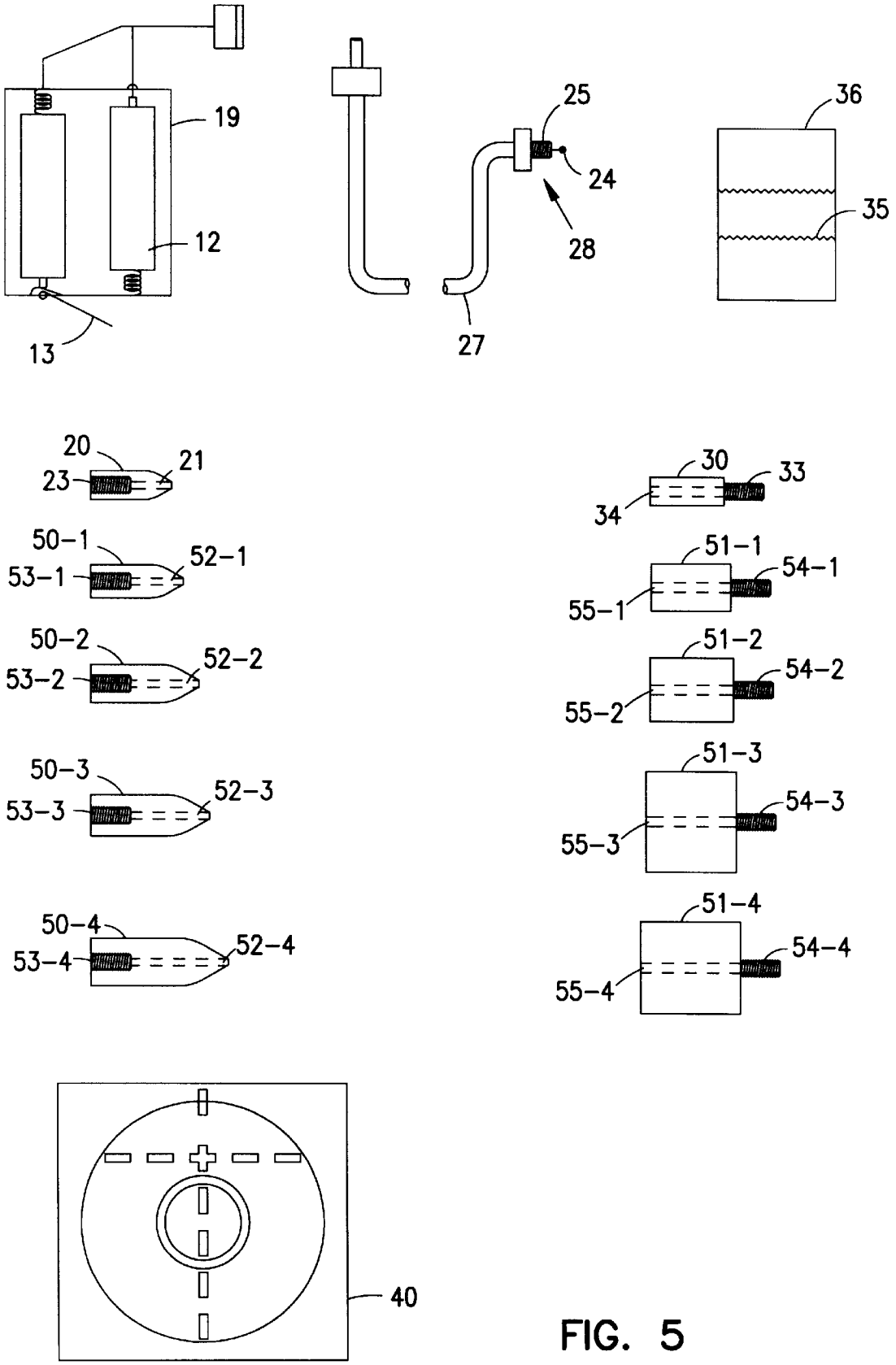
FIG. 5 is a view of an example of a complete bore sighting system.
Figure 6:
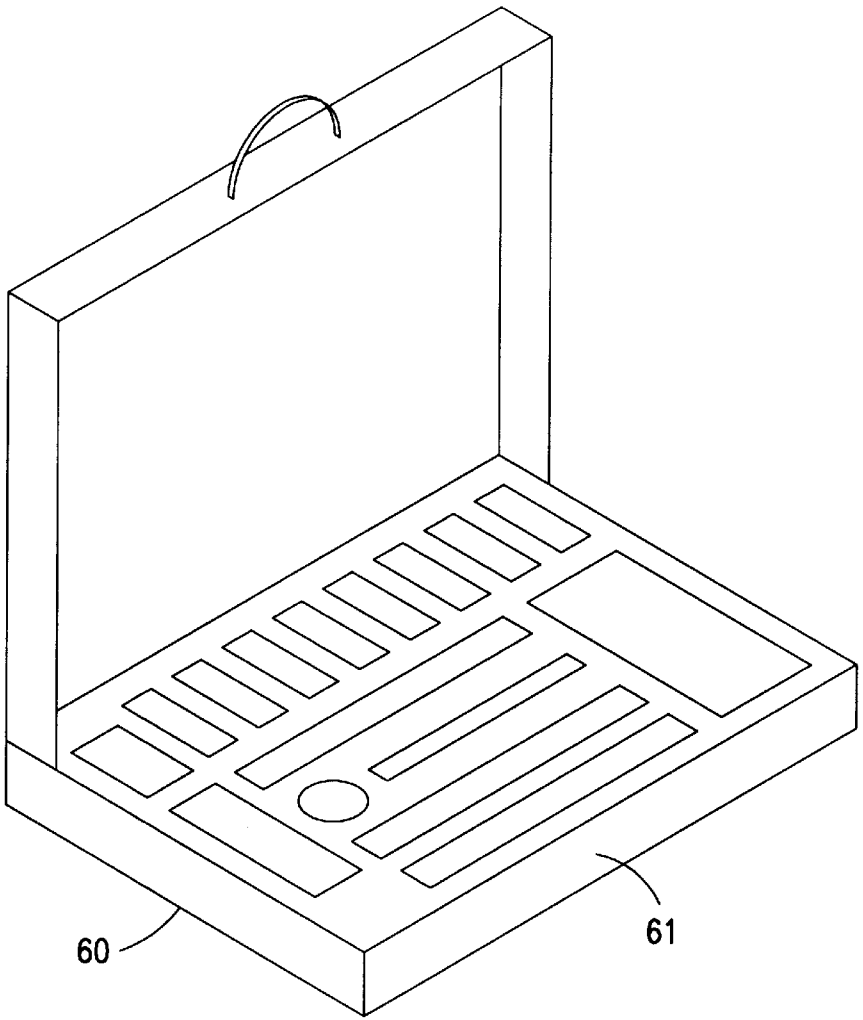
FIG. 6 is a broader view of a complete bore sighting system.

FIGS. 5 and 6 show an example of a complete system according to the invention. The user buys the system containing the necessary parts to practice the invention as described above. The bore sighting system optionally includes a carrying case 61, a single power source 12, single light source unit 28, a plurality of shell casings 20, 50-1, 50-2, 50-3, 50-4, a plurality of muzzle tubes 30, 51-1, 51-2, 51-3, 51-4, a single muzzle tube handle 36, and target 40. The user only need to buy this one system to be able to practice the invention on multiple types of guns. A bore sighting system could also contain any permutation of the parts described above. An advantage of the system is that it is inexpensively expandable. The user can originally buy a single light source unit and a single muzzle tube handle, and then separately purchase the interchangeable shell casings and interchangeable muzzle tubes for their guns as needed.

As shown in FIG. 5, each shell casing 20, 50-1, 50-2, 50-3, 50-4 has a different size and shape to match the caliber of gun 10. However, the mounting section 23, 53-1, 53-2, 53-3, 53-4 of each shell casing 20, 50-1, 50-2, 50-3, 50-4 is the same as every other mounting section 23, 53-1, 53-2, 53-3, 53-4, and also equal in size to the mounting section 25 of the single light source unit 28. This allows the shell casings 20, 50-1, 50-2, 50-3, 50-4 to be interchangeably mounted on the light source unit 28 depending on the caliber size of the gun 10 that is being sighted in. Each shell casing 20, 50-1, 50-2, 50-3, 50-4 has a passage 21, 52-1, 52-2, 52-3, 52-4, respectively. Examples of shell casing sizes include casings for 0.22, 30—30, 30-06, 7mm, 270, and 300 caliber guns.

Also shown in FIG. 5 is one embodiment of the invention in which there are five muzzle tubes 30, 51-1, 51-2, 51-3, 51-4, each having a different outside diameter. However, the mounting sections 33, 54-1, 54-2, 54-3, 54-4 of each of the muzzle tubes 30, 51-1, 51-2, 51-3, 51-4 are the same size as each other and the same size as the mounting section 35 of the single muzzle tube handle 36. This allows muzzle tubes 30, 51-1, 51-2, 51-3, 51-4 to be interchangeably mounted on the single muzzle tube handle 36 depending on the caliber of the gun 10 that is being sighted in. Each muzzle tube 30, 51-1, 51-2, 51-3, 51-4 has a central passage 34, 55-1, 55-2, 55-3, 55-4, respectively.

It is to be understood that the above description is intended to be descriptive and not restrictive. Other embodiments of the invention will be apparent to those of skill in the art upon reviewing the above description. The scope of the invention should, therefore, be determined with reference to the appended claims, along with the full scope of equivalents to which such claims are entitled.

What is claimed is:

1. A system for bore sighting a plurality of different caliber guns, comprising:

a single light source having a mounting section; and a plurality of separate shell casings, each shell casing having a different outer diameter size for inserting into a breech of one of the plurality of different caliber guns, each shell casing interchangeably mountable to the single light source mounting section.

2. The system according to claim 1 further comprising:

a power source;

an electrical connector for connecting the power source to the light source, the electrical connector being long enough so that the power source, located outside of the breech of the gun, is connectable to the light source, located inside of the breech of the gun; and a switch for activating and deactivating the power source.

3. A system for bore sighting a plurality of different caliber guns, comprising:

a single light source having a mounting section; and a plurality of separate shell casings, each shell casing having a different outer diameter size for inserting into a breech of one of the plurality of different caliber guns, each shell casing in the form of a hollow member having a passage axially located therethrough for allowing light from the light source to emit therefrom, each shell casing being substantially similar in shape to a standard cartridge for one of the plurality of different caliber guns, each shell casing having a mounting section that matches the size of the light source mounting section so that each of the plurality of shell casings is interchangeably attachable to the single light source mounting section.

4. An apparatus for bore sighting a gun, comprising:

a single light source;

a single power source;

an electrical connector for connecting the power source to the light source, the electrical connector being long enough so that the power source, located outside of a breech of the gun, is connectable to the light source, located inside of the breech of the gun;

a plurality of separate switch for activating and deactivating the power source; and a shell casings attachable to and detachable from the single light source, the shell casing in the form of a hollow member having a passage axially located therethrough for allowing light from the light source to emit therefrom, the shell casing being substantially similar in shape to a standard cartridge for the gun, wherein the outer diameter of the shell casing is substantially the same along a length of the shell casing so that the shell casing is supported along substantially its whole length within the gun.

5. The apparatus according to claim 4 further comprising:

a muzzle tube having an outer diameter of the same size as a barrel of the gun.

6. The apparatus according to claim 4 further comprising:

a target for reflecting light emitted by the light source to allow for calibration of a sight of the gun.

7. A method for bore sighting a gun, comprising:

selecting one of a plurality of separate shell casings appropriate to the caliber of the gun being sighted in, each of the plurality of separate shell casings having a different outer diameter;

attaching the selected shell casing to a single light source;

inserting the shell casing and light source into a breech of the gun;

activating the light source to shine through a barrel of the gun onto a target; and adjusting a sight of the gun depending on where the light hits the target.

8. The method of claim 7, further comprising attaching a single power source to the single light source.

9. A system for bore sighting a plurality of different caliber guns, the system comprising:

a plurality of separate shell casings, each of the plurality of shell casings having an inner passage for permitting the passage of light, each of the plurality of shell casings having a different outer diameter, wherein the outer diameter of each shell casing is substantially the same along a length of the shell casing so that the shell casing is supported along substantially its whole length when mounted within one of the plurality of different caliber guns;

a single light source, wherein each of the plurality of separate shell casings is interchangeably mountable to and demountable from the single light source.

10. The system according to claim 9, wherein each of the plurality of shell casings having a shape and a length substantially similar to a standard cartridge of one of the plurality of different caliber guns.

11. An apparatus for bore sighting a gun, the apparatus comprising:

a single light source;

a single power source;

an electrical connector for connecting the power source to the light source, the electrical connector being long enough so that the power source, located outside of a breech of the gun, is connectable to the light source, located inside of the breech of the gun;

a switch for activating and deactivating the power source; and a plurality of separate shell casings attachable to and detachable from the single light source, the shell casing in the form of a hollow member having a passage axially located therethrough for allowing light from the light source to emit therefrom, the shell casing being substantially similar in shape to a standard cartridge for the gun, wherein the outer diameter of the shell casing is substantially the same along a length of the shell casing so that the shell casing is supported along substantially its whole length within the gun.

* * * * *

UNITED STATES PATENT AND TRADEMARK OFFICE

CERTIFICATE OF CORRECTION

PATENT NO. : 6,237,236 B1
DATED : May 29, 2001
INVENTOR(S) : Tim Schnell

It is certified that error appears in the above-identified patent and that said Letters Patent is hereby corrected as shown below:

Column 5,
Line 26, delete "plurality of separate".
Line 39, referenced claim No. "4" should read -- 11 --.
Line 42, referenced claim No. "4" should read -- 11 --.

Column 6,
Line 28, delete "the apparatus".
Line 39, delete "a plurality of separate shell casings" and insert -- a shell casing --.

Signed and Sealed this

Twenty-third Day of April, 2002

*Attest:*

*Attesting Officer*

JAMES E. ROGAN
*Director of the United States Patent and Trademark Office*